United States Patent [19]

Sancini et al.

[11] Patent Number: 4,554,950

[45] Date of Patent: Nov. 26, 1985

[54] WEAVING MACHINE, ESPECIALLY A TERRY CLOTH WEAVING MACHINE

[75] Inventors: Aldo Sancini; Miguel A. Stacher, both of Arbon, Switzerland

[73] Assignee: Aktiengesellschaft Adolph Saurer, Arbon, Switzerland

[21] Appl. No.: 614,680

[22] Filed: May 29, 1984

[30] Foreign Application Priority Data

Jun. 9, 1983 [CH] Switzerland ..... 3161/83

[51] Int. Cl.[4] ..... D03D 39/22

[52] U.S. Cl. ..... 139/25; 139/434

[58] Field of Search ..... 139/25, 26, 429, 430, 139/434

[56] References Cited

U.S. PATENT DOCUMENTS

| | | | |
|---|---|---|---|
| 1,827,646 | 10/1931 | Gabler | 139/430 |
| 2,938,547 | 5/1960 | Dewas | 139/430 |
| 4,485,848 | 12/1984 | Eisenlohr | 139/434 |

*Primary Examiner*—Henry S. Jaudon

*Attorney, Agent, or Firm*—Werner W. Kleeman

[57] ABSTRACT

In a terry cloth weaving machine in which a horizontal translation of both warp thread systems of the upper shed and of the lower shed, together with the already woven fabric, takes place for the formation of loops and in which an apparatus for tucking or laying-in tucked or laid-in selvedges is arranged at each side of the machine for the fabrication of tucked or laid-in selvedges in the woven fabric, the tucking or laying-in needles of which tuck or lay the free ends or pick ends of the inserted weft threads back into the weaving shed, an apparatus for fixing the position of the apex of the weaving shed at least over the width of the associated tucked or laid-in selvedge is arranged at each of the sides of the machine. Each apparatus for fixing the position of the weaving shed apex comprises two bars or straight-edges parallel to the edge or fell of the fabric and to the apex line of the weaving shed, one of which engages the corresponding tucked or laid-in selvedge from above and the other from below. The straight-edges mutually overlap by a prescribed amount and are arranged sequentially in relation to the length of the fabric in a prescribed spaced relationship in which the straight-edge nearer to the weaving reed approximately coincides with the apex line of the weaving shed as well as with the edge or fell of the fabric and with the point of beat-up of the weft at the fabric fell by the weaving reed. This measure assures that, in particular, the weaving shed in the region of the tucking or laying-in needles always has the same opening, so that the weft thread ends tucked or laid back into the shed can be fixed better and flawless tucked or laid-in selvedges thereby obtained.

4 Claims, 7 Drawing Figures

WEAVING MACHINE, ESPECIALLY A TERRY CLOTH WEAVING MACHINE

BACKGROUND OF THE INVENTION

The present invention broadly relates to weaving machines or looms, and, more specifically, pertains to a new and improved construction of a weaving machine, especially a terry cloth weaving machine, wherein a horizontal translation of both warp thread systems of the upper shed and the lower shed, together with the already woven fabric, takes place for forming loops and an apparatus for tucking or laying-in the tucked or laid-in selvedges is arranged at each side of the machine for fabricating tucked or laid-in selvedges in the woven fabric and has tucking or laying-in needles for tucking or laying the free or pick ends of the inserted weft threads back into the weaving shed.

In weaving machines of the previously described type for the fabrication of terry cloth fabrics, plush fabrics, seersucker fabrics and the like, the horizontal translation of both warp thread systems of the upper shed and the lower shed, together with the already woven fabric, necessarily also causes a translation of the apex line of the weaving shed coincident with the fabric edge or fell, whereby the shed opening angle and with it the shed opening width changes considerably, particularly in the region of the tucking or laying-in position of the weft thread or pick ends to be laid in. In machines of the previously mentioned type in which the tucking or laying-in needles must retract from the weaving shed before closure of the shed, the changing shed opening often leads to a jumping out of the previously tucked or laid-in thread ends or at least to a change in their position so that tucked or laid-in selvedges of high quality cannot be obtained.

SUMMARY OF THE INVENTION

Therefore, with the foregoing in mind it is a primary object of the present invention to provide a new and improved construction of a terry cloth weaving machine which does not have associated with it the aforementioned drawbacks and shortcomings of the prior art constructions.

Now in order to implement these and still further objects of the invention, which will become more readily apparent as the description proceeds, the weaving machine of the present invention is manifested by the features that an apparatus for fixing the position of the apex line of the weaving shed over at least the width of an associated tucked or laid-in selvedge or edge region is fixedly arranged at both sides of the weaving machine.

By this fixing of the position of the apex line of the weaving shed according to the invention an essentially constant shed opening angle and with it an essentially constant shed opening width is obtained, at least at the regions of the tucking or laying-in positions at the corresponding tucked or laid-in selvedges, independently of an inevitable horizontal translation or displacement of the fabric edge or fell in the direction of the warp thread length, which assures a positionally certain tucking or laying-in of the corresponding weft thread ends into the weaving shed.

Such an apparatus for fixing the position of the apex of the weaving shed, which will hereinafter be referred to as a shed-closer, can be relatively simply designed and also permit an easy retrofitting of existing machinery.

Such a shed-closer can, according to the invention, comprise two bars or straight-edges disposed parallel to the fabric edge or fell and to the apex line of the weaving shed, one of which engages the tucked or laid-in selvedge from above and the other from below. Furthermore, the straight-edges can overlap by a prescribed amount and can be arranged in a prescribed spaced relationship sequentially in relation to the length of the fabric. The straight edge nearer to the weaving reed coincides approximately with the apex line of the weaving shed as well as with the edge or fell of the fabric and with the point of beat-up of the weft at the cloth or fabric fell by the weaving reed.

Thus, the deflection edge of the straight-edge nearer to the weaving reed determines the now positionally fixed apex line of the weaving shed.

Advantageously, the straight-edge nearer to the weaving reed is the one to engage the corresponding tucked or laid-in selvedge from below and the guiding edges of the straight-edge are preferably constructed as deflecting slide paths or tracks for the warp thread system of the upper shed and the lower shed and of the woven fabric to be translated in order to engage the fabric or the warp threads without damaging them.

It is also advantageous for the overlap and the spaced relationship of the straight-edges to be adjustable in order to enable an easy adaptation to changing operating conditions.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
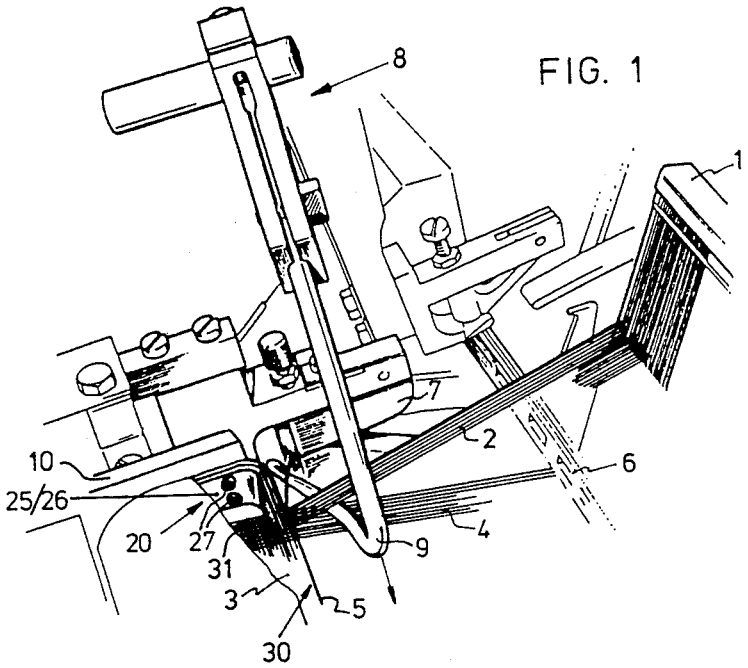
FIG. 1 schematically shows a terry cloth weaving machine with an apparatus for tucking or laying-in edges and a shed-closer according to the invention in partial perspective view.

Describing now the drawings, it is to be understood that to simplify the showing of the drawings only enough of the structure of the terry cloth weaving machine or loom has been illustrated as is needed to enable one skilled in the art to readily understand the underlying principles and concepts of this invention. The illustrated exemplary embodiment of the terry cloth weaving machine will be seen to comprise a so-called gripper terry cloth weaving machine or loom illustrated in partial perspective view in FIG. 1. The gripper terry cloth weaving machine has a weaving reed 1 in which the not particularly referenced warp threads of the upper shed 2 and the lower shed 4 are guided in conventional manner. The warp threads together with the inserted weft threads 5 produce the woven fabric 3. The insertion of the weft or weft threads 5 is performed by a suitable gripper mounted on a rapier or gripper carrier 6 which enters between the upper shed 2 and the lower shed 4.

In conventional manner, the inserted weft threads 5 are each held at their ends protruding from the shed by means of a thread clamp or holder 7 and are beaten into the fabric edge of fell 30 by the weaving reed 1. An apparatus 8 for tucking or laying-in selvedges having a tucking or laying-in needle 9 at each side of the fabric then grips the corresponding weft thread end and tucks or lays the latter back into the weaving shed to form a tucked or laid-in fabric edge or selvedge 31, as can readily be seen in FIG. 1.

Then, the horizontal translation of the warp thread system defined by the upper shed 2 and lower shed 4 together with the already woven fabric 3 in the direction of the warp thread length is carried out by means of needle or porcupine rolls or the like in a manner suitable for forming loops. In this operation the previously mentioned problems arise but will be eliminated by a so-called shed- closer 20 according to the invention, as will be described in more detail in relation to FIG. 2 in the following.

Figure 2:
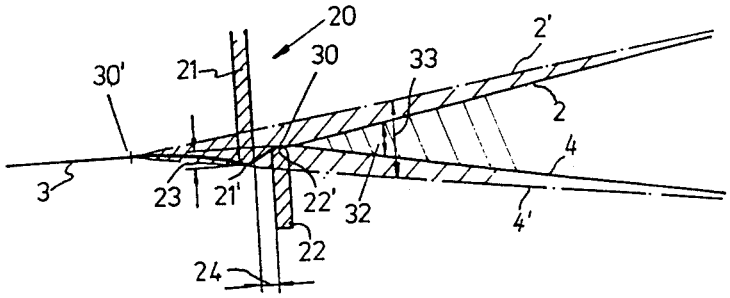
FIG. 2 is a schematic diagram illustrating the effect of the horizontal fabric translation or displacement upon the shed opening angle with and without the shed-closer according to the invention.

It can be seen in FIG. 2 that the apex line 30 of the weaving shed, without the apparatus 20 for fixing the position of the apex line of the weaving shed (which here also represents the edge or fell of the fabric and simultaneously the point of beat-up by the weaving reed), is shifted or translated by the previously mentioned horizontal translation to the position 30'. This causes the shed opening defined by the upper shed 2 and the lower shed 4 at the position of laying-in tucking or the corresponding weft thread end to increase from a width 32 to a width 33 of the shed opening defined by the upper shed 2' and the lower shed 4'. This increased shed opening width is caused by an inevitable change of the thread opening angle, and leads to an inadequate fixation of the position of the tucked or laid-in thread ends. These different shed openings are indicated in FIG. 2 by varying cross-hatching.

In order to counter this effect, one of the previously mentioned apparatuses 20 for fixing the position of the apex line 30 of the weaving shed at least over the width of the corresponding tucked or laid in selvedges 31 is fixed at each side of the machine upon the machine frame 10 as can be seen in FIG. 1.

Figure 3:
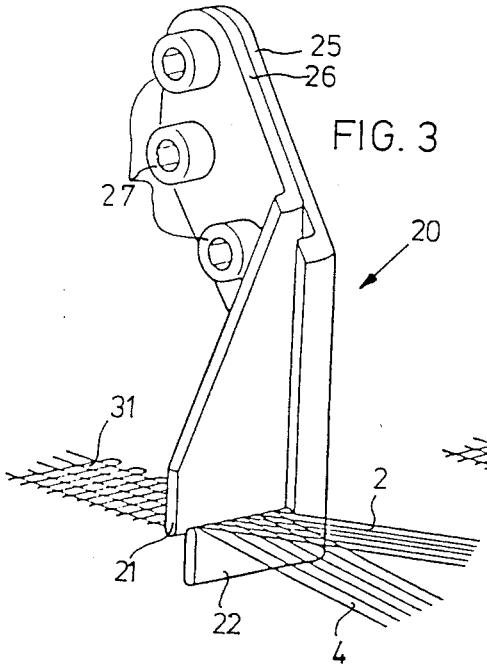
FIG. 3 schematically shows a first embodiment of the shed-closer of FIG. 1 according to the invention in perspective view.

As can be seen from FIGS. 2 and 3, such an apparatus or shed-closer 20 comprises two bars or straight-edges 21 and 22 disposed parallel to the fabric edge or fell and to the apex line 30 of the weaving shed. One straight-edge 21 engages the associated tucked or laid-in selvedge 31 from above and the other straight-edge 22 engages the tucked or laid-in selvedge 31 from below. The straight-edges 21 and 22 overlap by a prescribed amount 23 and are also sequentially spaced in the direction of the fabric length by a prescribed distance 24 as can be seen in FIG. 2. The straight-edge 22 nearest to the weaving reed 1 is approximately flush with or coincident with the apex line 30 of the weaving shed as well as with the fabric edge or fell and with the weft beat-up point of the weaving reed.

It is advantageous for the straight-edge engaging the tucked or laid-in selvedge 31 from below to be the straight-edge 22 nearest the weaving reed 1. The guide edges 21' and 22' of the straight-edges 21 and 22 form deflecting slide paths or tracks for the warp thread system of the upper shed 2 and the lower shed 4 as well as the woven fabric 3, each of which is to be horizontally translated as is best seen in FIG. 2.

By means of this arrangement and design of the shed-closer 20, the effect is obtained that by deflecting the fabric or cloth 3 and the warp thread systems of the upper shed 2 and the lower shed 4 by means of the straight-edges 21 and 22, the weaving shed apex line 30 remains in a fixed position, namely at the deflecting edge 22' of the straight-edge 22 nearest the weaving reed 1, independent of any translation or shift of both warp thread systems of the upper shed 2 and the lower shed 4 and of the already woven fabric 3. That is, the shed opening now retains its width 32 even when the fabric edge is shifted or translated toward the point 30' in FIG. 2.

For adapting the previously described arrangement to varying materials, operating conditions and the like, it is advantageous for the overlap 23 and the spaced relationship 24 of the straight-edges 21 and 22 to be adjustable.

In the embodiment of the shed-closer 20 according to FIG. 3, the straight-edges 21 and 22 each extend outwardly from mounting or base plates 25 and 26 which bear upon one another and are mutually adjustable upon release of fixing screws 27 or equivalent facilities.

Figure 5:
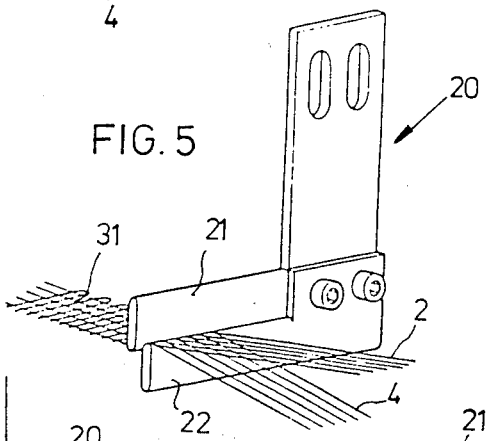
Figure 6:
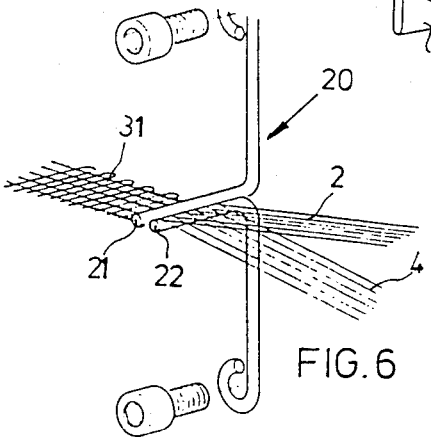
Figure 7:
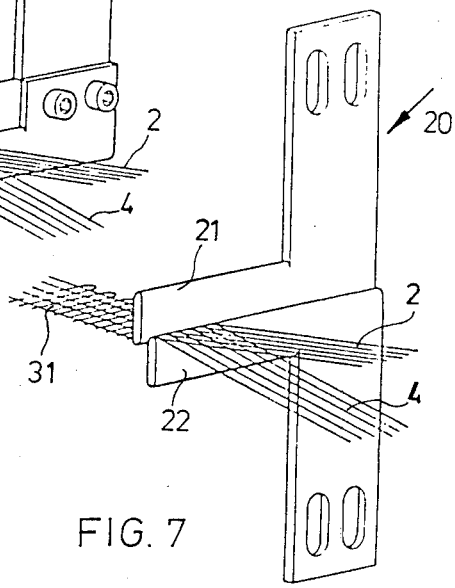

Simplified shed-closers 20 are shown in FIGS. 5 and 7 which have at least partially mutually adjustable straight-edges 21 and 22. The shed-closer 20 illustrated in FIG. 6 is further simplified and is formed solely by shapes bent from wire or rod.

Figure 4:
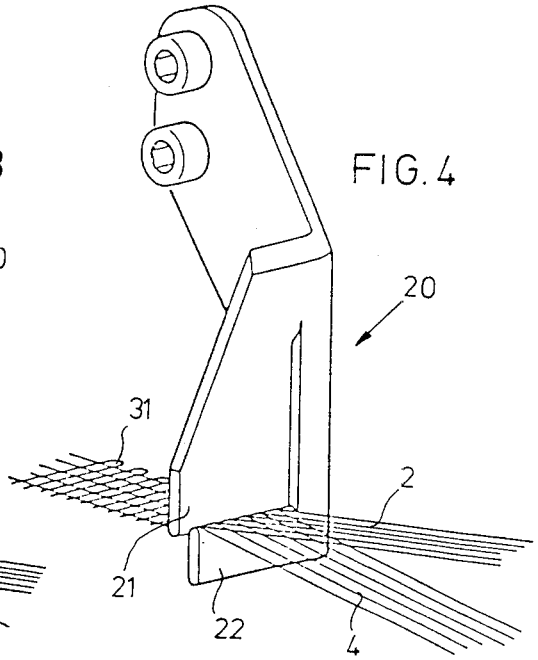
FIGS. 4 through 7 schematically show further alternative embodiments of the shed-closer of FIG. 1 according to the invention in perspective view.

A shed-closer 20 such as that shown in FIG. 4 in which both straight-edges 21 and 22 are mutually fixed and non-adjustable and therefore have a fixed, prescribed overlap and a fixed, prescribed spaced relationship can also be employed.

Further design variations are possible without departing from the conceptual basis and teachings of the invention.

A terry cloth weaving machine or loom incorporating the above-mentioned features has, due to the fixed position of the apex line of the weaving shed according to the invention and independent of any inevitable horizontal translation of the fabric edge or fell in the direction of the warp thread length, a constant shed opening angle and therefore, at least at the region of the tucking or laying-in position at the corresponding tucked or laid-in selvedge, a constant width of shed opening, which assures a positionally certain tucking or laying-in of the corresponding weft thread end into the weaving shed and therefore a high-quality tucked or laid-in selvedge.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. In a weaving machine, especially a terry cloth weaving machine, wherein:

a horizontal translation of both warp thread systems of an upper shed and of a lower shed together with the already woven fabric takes place for forming loops;

an apparatus for laying-in laid-in edges arranged at each side of the machine for fabricating laid-in edges in the woven fabric;

said apparatus for laying-in laid-in edges having laying-in needles for laying free ends of inserted weft threads back into the weaving shed; the improvement which comprises:

an apparatus for fixing the position of an apex line of the weaving shed over at least the width of an associated laid-in edge region of the fabric fixedly arranged at each side of the weaving machine;

each said apparatus for fixing the position of the apex line of the weaving shed comprising two straight-edges extending substantially parallel to the fabric fell and to the apex line of the weaving shed;

one of said two straight-edges engaging the laid-in edge from above and the other straight-edge engaging the laid-in edge from below;

the two straight-edges mutually overlapping in a prescribed spaced relationship in a direction extending transverse to a plane of the already woven fabric;

the two straight-edges being arranged sequentially in relation to the length of the fabric in a prescribed spaced relationship in a longitudinal direction of the already woven fabric; and one of the two straight-edges being arranged nearer to a weaving reed of the weaving machine and approximately coincident with the apex line of a selvedge portion of the weaving shed and with a point of weft beat-up of the weaving reed.

2. The weaving machine as defined in claim 1, further including:

means for adjusting an overlap of said two straight-edges; and means for adjusting said spaced relationship of the two straight-edges in the direction of the length of the fabric.

3. The weaving machine as defined in claim 1, wherein:

said one of said two straight-edges arranged nearer to the weaving reed of the weaving machine comprises said one of the straight-edges engaging the laid-in edge from below.

4. The weaving machine as defined in claim 1, wherein:

said two straight-edges define guiding edges; and said guiding edges defining deflecting slide paths for said warp thread systems of the upper shed and of the lower shed to be translated and the woven fabric to be translated.

* * * * *